US010891936B2

(12) United States Patent
Bastyr

(10) Patent No.: US 10,891,936 B2
(45) **Date of Patent: *Jan. 12, 2021**

(54) VOICE ECHO SUPPRESSION IN ENGINE ORDER CANCELLATION SYSTEMS

(71) Applicant: Harman International Industries, Incorporated, Stamford, CT (US)

(72) Inventor: Kevin J. Bastyr, Franklin, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/432,197

(22) Filed: Jun. 5, 2019

(65) Prior Publication Data

US 2020/0388267 A1 Dec. 10, 2020

(51) Int. Cl.
*G10K 11/178* (2006.01)
*G10L 21/0208* (2013.01)

(52) U.S. Cl.
CPC .. *G10K 11/17854* (2018.01); *G10K 11/17881* (2018.01); *G10L 21/0208* (2013.01); *G10K 2210/1282* (2013.01); *G10K 2210/3028* (2013.01)

(58) Field of Classification Search
USPC ..... 381/71.4, 71.11, 86
See application file for complete search history.

(56) References Cited

U.S. PATENT DOCUMENTS 5,408,532 A * 4/1995 Yokota ..... G10K 11/1784 181/206
5,410,606 A * 4/1995 Imai ..... G10K 11/178 381/71.14
5,524,057 A * 6/1996 Akiho ..... G10K 11/178 381/94.7
5,581,619 A * 12/1996 Shibata ..... G10K 11/178 381/71.11
5,638,305 A * 6/1997 Kobayashi ..... G10K 11/178 700/280

(Continued)

FOREIGN PATENT DOCUMENTS

CN 107093429 A 8/2017
EP 1780704 A1 5/2007
WO 2011112417 A1 9/2011

*Primary Examiner* — David L Ton
(74) *Attorney, Agent, or Firm* — Brooks Kushman P.C.

(57) ABSTRACT

Engine order cancellation (EOC) systems generate feed forward noise signals based on the engine or other rotating shaft RPM and use those signals and adaptively configured W-filters to reduce the in-cabin SPL by radiating anti-noise through speakers. An EOC system may include a signal analysis controller for detecting non-stationary events, such as speech, based on parameters sampled from a current frame of error signals output from microphones positioned in various locations of a vehicle passenger cabin. Upon detection, the signal analysis controller may mitigate the effects of the non-stationary event to prevent the EOC system from boosting noise or contributing to a speech-like post-echo in the passenger cabin. For example, if speech is detected in a frame, then the adaptation can be frozen for that frame. Alternatively, the signal analysis controller may adaptively subtract voice signals out of the error microphone signal.

20 Claims, 3 Drawing Sheets

(56) References Cited

U.S. PATENT DOCUMENTS

| | | | | |
|---|---|---|---|---|
| 7,117,145 | B1 * | 10/2006 | Venkatesh | G10L 21/0208 704/200 |
| 10,360,895 | B2 * | 7/2019 | Cheung | G10K 11/17827 |
| 10,565,979 | B1 * | 2/2020 | Christian | G10K 11/17881 |
| 10,580,399 | B1 * | 3/2020 | Bastyr | G10K 11/17825 |
| 10,593,317 | B1 * | 3/2020 | Bastyr | G10K 11/17823 |
| 2004/0247137 | A1 * | 12/2004 | Inoue | G10K 11/178 381/71.4 |
| 2006/0056642 | A1 * | 3/2006 | Inoue | G10K 11/178 381/71.11 |
| 2008/0181422 | A1 * | 7/2008 | Christoph | G10K 11/17817 381/73.1 |
| 2008/0192948 | A1 * | 8/2008 | Kan | F02B 77/13 381/71.4 |
| 2009/0279710 | A1 * | 11/2009 | Onishi | G10K 11/178 381/71.4 |
| 2013/0129108 | A1 * | 5/2013 | Wurm | G10K 11/16 381/71.11 |
| 2014/0294189 | A1 * | 10/2014 | Pan | G10K 11/16 381/71.4 |
| 2015/0010163 | A1 * | 1/2015 | Ganeshkumar | H04R 3/002 381/71.4 |
| 2016/0012815 | A1 | 1/2016 | Yano | |
| 2018/0070191 | A1 * | 3/2018 | Chang | G10K 11/17885 |
| 2018/0240452 | A1 * | 8/2018 | Every | G10K 11/178 |
| 2018/0277090 | A1 * | 9/2018 | Christoph | G10K 11/17881 |
| 2019/0071026 | A1 | 3/2019 | Terashima et al. | |
| 2019/0126845 | A1 * | 5/2019 | Tao | G10K 11/178 |
| 2019/0270350 | A1 * | 9/2019 | Bastyr | G10K 11/1785 |
| 2020/0005760 | A1 * | 1/2020 | Tao | G10K 11/17854 |
| 2020/0135167 | A1 * | 4/2020 | Kano | G10K 11/17825 |

* cited by examiner

VOICE ECHO SUPPRESSION IN ENGINE ORDER CANCELLATION SYSTEMS

TECHNICAL FIELD

The present disclosure is directed to engine order cancellation and, more particularly, to detecting voices or other non-stationary events in a feed-forward engine order cancellation system to minimize mis-adaptation.

BACKGROUND

Active Noise Control (ANC) systems attenuate undesired noise using feedforward and feedback structures to adaptively remove undesired noise within a listening environment, such as within a vehicle cabin. ANC systems generally cancel or reduce unwanted noise by generating cancellation sound waves to destructively interfere with the unwanted audible noise. Destructive interference results when noise and "anti-noise," which is largely identical in magnitude but opposite in phase to the noise, combine to reduce the sound pressure level (SPL) at a location. In a vehicle cabin listening environment, potential sources of undesired noise come from the engine, the interaction between the vehicle's tires and a road surface on which the vehicle is traveling, and/or sound radiated by the vibration of other parts of the vehicle. Therefore, unwanted noise varies with the speed, road conditions, and operating states of the vehicle.

An Engine Order Cancellation (EOC) system is a specific ANC system implemented on a vehicle to reduce the level of unwanted vehicle interior noise originating from the narrow band acoustic and vibrational emissions from the vehicle engine and exhaust system or other rotating drivetrain components. EOC systems generate feed forward noise signals based on the engine or other rotating shaft RPM and use those signals and adaptively configured W-filters to reduce the in-cabin SPL by radiating anti-noise through speakers. EOC systems are susceptible to divergence of the adaptive W-filters.

EOC systems are typically Least Mean Square (LMS) adaptive feed-forward systems that continuously adapt W-filters based on both an RPM input from a sensor mounted to the drive shaft and on signals of microphones located in various positions inside the vehicle's cabin. Certain events, such as when the vehicle hits a speedbump or pothole, or when the occupants of the vehicle speak, induces signals on the error microphone outputs. The LMS EOC system continuously adapts the W-filters, and so it will adapt the W-filters to more optimally cancel the portion of these voice or impulsive signals occurring at the engine order frequencies. However, these types of events are transients, and are not indicative noise radiated by the engine and exhaust system. Therefore, when the W-filters are adapted based on these transient, non-stationary events, the EOC is worsened for a period of time after the non-drivetrain related acoustic events. This is because the EOC system needs to re-adapt to re-converge to the correct W-filters to optimally cancel the steady-state or pseudo-steady state engine and exhaust system sound.

SUMMARY

In one or more illustrative embodiments, a method for preventing mis-adaptation in a feed-forward engine order cancellation (EOC) system is provided. The method may include adjusting an adaptive transfer characteristic based on a noise signal received from a noise signal generator, an error signal received from a microphone located in a cabin of a vehicle, and an adaptation parameter. The method may further include generating an anti-noise signal based in part on the adaptive transfer characteristic, wherein the anti-noise signal is to be radiated by a speaker as anti-noise within the cabin of the vehicle. The method may further include detecting a non-stationary event based on signal parameters sampled from a frame of the error signal and modifying the adaptation parameter for a duration of the frame in response to detecting the non-stationary event.

Implementations may include one or more of the following features. Detecting a non-stationary event based on signal parameters sampled from a frame of the error signal may include: comparing at least one signal parameter of a current frame for the error signal to a threshold; and detecting the non-stationary event when the at least one signal parameter exceeds the threshold. Further, the signal parameter may be one of a peak amplitude of the error signal sampled in the frame and an energy value of each frame. The threshold may be a predetermined static threshold programmed for the EOC system. Alternatively, the threshold may be a dynamic threshold computed from a statistical analysis of the at least one signal parameter in one or more preceding frames of the error signal.

Moreover, detecting a non-stationary event based on signal parameters sampled from a frame of the error signal may include: applying a peak tracker and a valley tracker, using a voice activity detector, to a current frame of the error signal to determine the amplitude and number of peaks in the current frame; and detecting a presence of speech when a predetermined number of peaks exceed a predetermined value over a predetermined duration. Additionally, modifying an adaption parameter may include reducing a rate of adaptation of one or more controllable filters, pausing adaptation of one or more controllable filters by reducing a rate of adaptation of the controllable filters to zero, or deactivating the EOC system for the duration of the frame.

One or more additional embodiments may be directed to an EOC system including a noise signal generator, a controllable filter, and adaptive filter controller, and a signal analysis controller. The noise signal generator may be adapted to generate a noise signal in response to an input. The controllable filter may be adapted to generate an anti-noise signal based in part on an adaptive transfer characteristic. The anti-noise signal is to be radiated by a speaker as anti-noise within a cabin of a vehicle. The adaptive filter controller may include a processor and memory programmed to control the adaptive transfer characteristic of the controllable filter based on the noise signal received from the noise signal generator, an error signal received from a microphone located in the cabin of the vehicle, and an adaptation parameter. The signal analysis controller may include a processor and memory programmed to: detect a non-stationary event based on parameters sampled from a current frame of the error signal; and modify at least one of the adaptation parameter and the error signal in response to detecting the non-stationary event.

Implementations may include one or more of the following features. The adaptation parameter may determine a rate of change of the adaptive transfer characteristic for the controllable filter. The signal analysis controller may be programmed to modify the adaption parameter by reducing a rate of adaptation of the controllable filters. The signal analysis controller may be programmed to modify the error signal by removing non-stationary noise indicated by the non-stationary event to generate an adjusted error signal. The EOC system may further include a voice activity detector that detects speech present in the error signal, wherein the non-stationary event includes the speech. The voice activity detector may be configured to determine a zero-crossing rate in the current frame of the error signal.

The signal analysis controller may be programmed to detect a non-stationary event based on parameters sampled from a current frame of the error signal by comparing at least one signal parameter of a current frame for each error signal to a threshold. The noise signal generator may include an RPM sensor, a lookup table, and a frequency generator.

One or more additional embodiments may be directed to a computer-program product embodied in a non-transitory computer readable medium that is programmed for EOC. The computer-program product may include instructions for: receiving noise signals from at least one noise signal generator; generating an anti-noise signal to be radiated by a speaker as anti-noise within a cabin of a vehicle, the anti-noise signal being generated by at least one controllable filter based in part on the noise signals from the at least one noise signal generator; receiving error signals from at least one microphone located in the cabin of the vehicle; detecting a non-stationary event based on signal parameters sampled from a frame of at least one error signal; and modifying the anti-noise signal for the duration of the frame in response to detecting the non-stationary event.

Implementations may include one or more of the following features. The instructions for modifying an anti-noise signal may include instructions for modifying an adaptation parameter that controls a rate of adaptation of the controllable filter. Alternatively, the instructions for modifying an anti-noise signal may include instructions for modifying the error signal by removing non-stationary noise indicative of the non-stationary event to obtain an adjusted error signal.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof.

Figure 1:
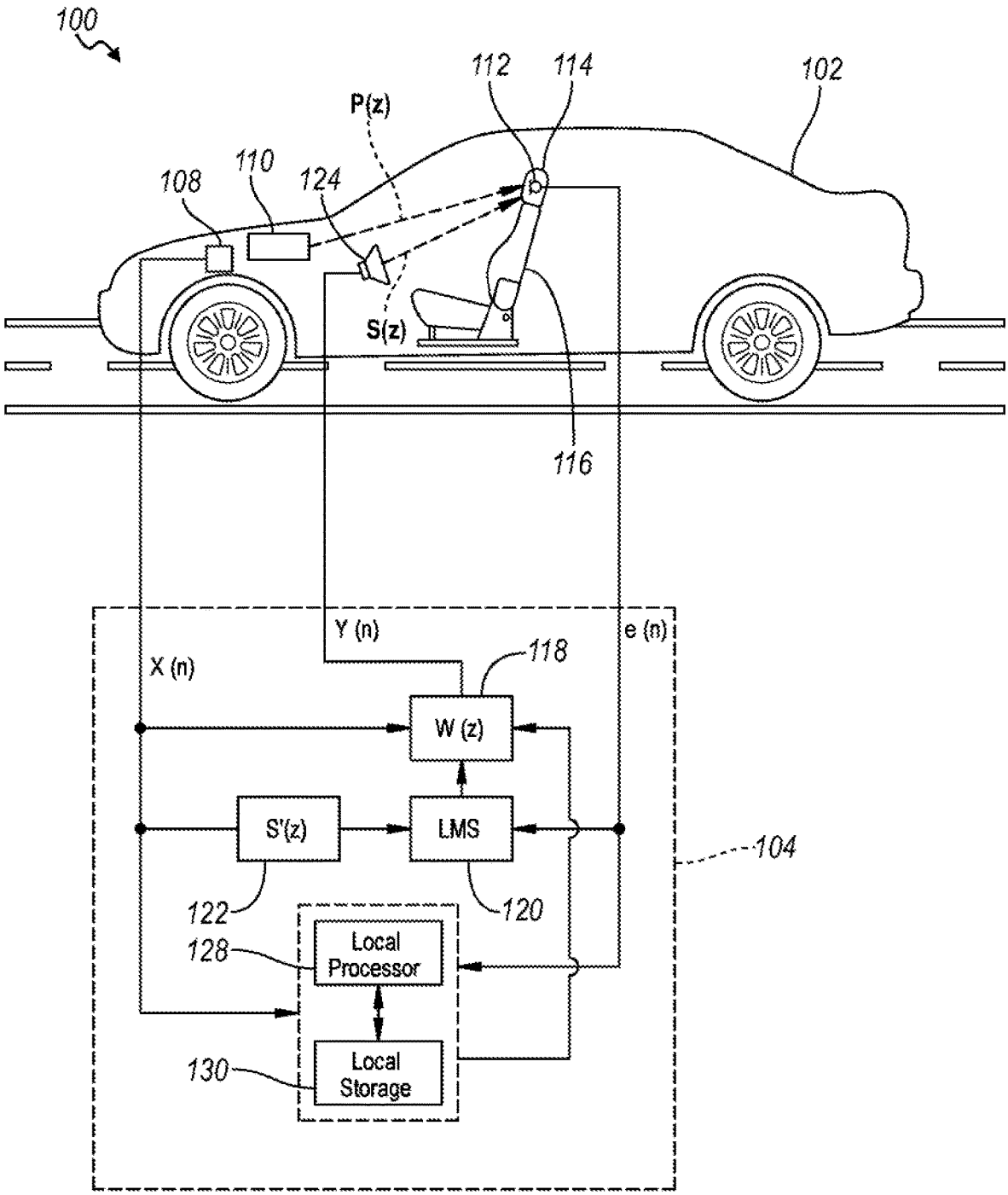
FIG. 1 is a block diagram of a vehicle having an engine order cancellation (EOC) system, in accordance with one or more embodiments of the present disclosure.

FIG. 1 shows an engine order cancellation (EOC) system 100 for a vehicle 102 having a noise signal generator 108. The noise signal generator 108 may generate reference noise signals X(n) corresponding to audible engine order noise for each engine order originating from a vehicle engine and exhaust system 110. The EOC system 100 may be integrated with a feed-forward and feedback active noise control (ANC) framework or system 104 that generates anti-noise by adaptive filtering of the noise signals X(n) from noise signal generator 108 using one or more microphones 112. An anti-noise signal Y(n) may then be played through one or more speakers 124. S(z) represents a transfer function between a single speaker 124 and a single microphone 112. While FIG. 1 shows a single noise signal generator 108, microphone 112, and speaker 124 for simplicity purposes only, it should be noted that typical EOC systems can include multiple engine order noise signal generators 108, in addition to multiple speakers 124 (e.g., 4 to 8), and microphones 112 (e.g., 4 to 6).

Figure 2:
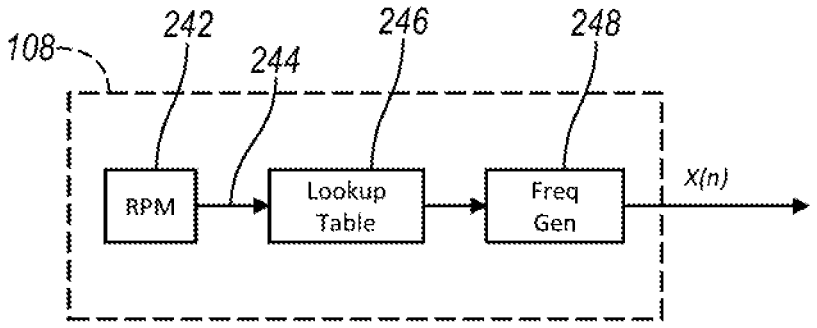
FIG. 2 is a detailed view of a noise signal generator depicted in FIG. 1, in accordance with one or more embodiments of the present disclosure.

With reference to FIG. 2, the noise signal generator 108 may include an RPM sensor 242, which may provide an RPM signal 244 (e.g., a square-wave signal) indicative of rotation of an engine drive shaft or other rotating shaft indicative of the engine rotational speed. In some embodiments, the RPM signal 244 may be obtained from a vehicle network bus (not shown). As the radiated engine orders are directly proportional to the drive shaft RPM, the RPM signal 244 is representative of the frequencies produced by the drivetrain, including the engine and exhaust system. Thus, the signal from the RPM sensor 242 may be used to generate reference engine order signals corresponding to each of the engine orders for the vehicle. Accordingly, the RPM signal 244 may be used in conjunction with a lookup table 246 of RPM vs. Engine Order Frequency.

More specifically, the lookup table 246 may be used to convert the RPM signal 244 into one or more engine order frequencies. The frequency of a given engine order at the sensed RPM, as retrieved from the lookup table 246, may be supplied to an oscillator or frequency generator 248, thereby generating a sine wave at the given frequency. This sine wave represents a noise signal X(n) indicative of engine order noise for a given engine order. As there may be multiple engine orders, the EOC system 100 may include multiple noise signal generators 108 and/or frequency generators 248 for generating a noise signal X(n) for each engine order based on the RPM signal 244.

An engine rotating at a rate of 1800 RPM can be said to be running at 30 Hz (1800/60=30), which corresponds to the fundamental or primary engine order frequency. For a four-cylinder engine, two cylinders are fired during each crank revolution, resulting in the 60-Hz (30×2=60) dominant frequency that defines the four-cylinder engine's sound at 1800 RPM. In a four-cylinder engine, it's also called the "second engine order" because the frequency is two times that of the engine's rotational rate. At 1800 RPM, the other dominant engine orders of a four-cylinder engine are the $4^{th}$ order, at 120 Hz, and the $6^{th}$ order, at 180 Hz. In a six-cylinder engine, the firing frequency results in a dominant third engine order; in a V-10, it's the fifth engine order that is dominant. As the RPM increases, the firing frequency rises proportionally. As previously described, the EOC system 100 may include multiple noise signal generators 108 and/or frequency generators 248 for generating a noise signal X(n) for each engine order based on an RPM signal 244. Further, the ANC framework 104 (e.g., controllable filter 118, adaptive filter controller 120, secondary path filter 122) within the EOC system 100 may be scaled to reduce or cancel each of these multiple engine orders. For instance, an EOC system that reduces the $2^{nd}$, $4^{th}$, and $6^{th}$ engine orders requires three of the ANC frameworks or subsystems 104, one for each engine order. Certain system components such as the error microphones 112 and the anti-noise speakers 124 may be common to all systems or subsystems.

Referring back to FIG. 1, the characteristic frequencies of noise and vibrations that originate from the engine and exhaust system 110 may be sensed by one or more of the RPM sensors 242 optionally contained within the noise signal generator 108. The noise signal generator 108 may output a noise signal X(n), which is a signal that represents a particular engine order frequency. As previously described, noise signals X(n) are possible at different engine orders of interest. Moreover, these noise signals may be used separately or may be combined in various ways known by those skilled in the art. The noise signal X(n) may be filtered with a modeled transfer characteristic S'(z), which estimates the secondary path (i.e., the transfer function between an anti-noise speaker 124 and an error microphone 112), by a secondary path filter 122.

Drivetrain noise (e.g., engine, drive shaft, or exhaust noise) is transferred, mechanically and/or acoustically, into the passenger cabin and is received by the one or more microphones 112 inside the vehicle 102. The one or more microphones 112 may, for example, be located in a headrest 114 of a seat 116 as shown in FIG. 1. Alternatively, the one or more microphones 112 may be located in a headliner of the vehicle 102, or in some other suitable location to sense the acoustic noise field heard by occupants inside the vehicle 102. The engine, driveshaft and/or exhaust noise is transferred to the microphone 112 according to a transfer characteristic P(z), which represents the primary path (i.e., the transfer function between actual noise sources and an error microphone).

The microphones 112 may output an error signal e(n) representing the noise present in the cabin of the vehicle 102 as detected by the microphones 112. In the EOC system 100, an adaptive transfer characteristic W(z) of a controllable filter 118 may be controlled by adaptive filter controller 120. The adaptive filter controller 120 may operate according to a known least mean square (LMS) algorithm based on the error signal e(n) and the noise signal X(n), which is optionally filtered with the modeled transfer characteristic S'(z) by the filter 122. The controllable filter 118 is often referred to as a W-filter. The LMS adaptive filter controller 120 may provide a summed cross-spectrum configured to update the transfer characteristic W(z) filter coefficients based on the error signals e(n). The process of adapting or updating W(z) that results in improved noise cancellation is referred to as converging. Convergence refers to the creation of W-filters that minimize the error signals e(n), which is controlled by a step size governing the rate of adaption for the given input signals. The step size is a scaling factor that dictates how fast the algorithm will converge to minimize e(n) by limiting the magnitude change of the W-filter coefficients based on each update of the controllable W-filter 118.

The anti-noise signal Y(n) may be generated by an adaptive filter formed by the controllable filter 118 and the adaptive filter controller 120 based on the identified transfer characteristic W(z) and the noise signal, or a combination of noise signals, X(n). The anti-noise signal Y(n) ideally has a waveform such that when played through the speaker 124, anti-noise is generated near the occupants' ears and the microphone 112 that is substantially opposite in phase and identical in magnitude to that of the engine order noise audible to the occupants of the vehicle cabin. The anti-noise from the speaker 124 may combine with engine order noise in the vehicle cabin near the microphone 112 resulting in a reduction of engine order noise-induced sound pressure levels (SPL) at this location. In certain embodiments, the EOC system 100 may receive sensor signals from other acoustic sensors in the passenger cabin, such as an acoustic energy sensor, an acoustic intensity sensor, or an acoustic particle velocity or acceleration sensor to generate error signal e(n).

Vehicles often have other shafts rotating at other rates relative to the engine RPM. For example, the driveshaft rotates at a rate related to the engine by the current gear ratio set by the transmission. A driveshaft may not have a perfect rotating balance, as it may have some degree of eccentricity. When rotated, the eccentricity gives rise to a rotating imbalance that imparts an oscillating force on the vehicle, and these vibrations may result in audible acoustic sound in the passenger cabin. Other rotating shafts that rotate at a rate different than the engine include the half shafts, or axels, that rotate at a rate set by the gear ratio in their differentials. In certain embodiments, the noise signal generator 108 can have an RPM sensor on a different rotating shaft, such as a drive shaft or half shafts.

While the vehicle 102 is under operation, a processor 128 may collect and optionally processes the data from the RPM sensor 242 in the noise signal generator 108 and the microphones 112 to construct a database or map containing data and/or parameters to be used by the vehicle 102. The data collected may be stored locally at a storage 130, or in the cloud, for future use by the vehicle 102. Examples of the types of data related to the EOC system 100 that may be useful to store locally at storage 130 include, but are not limited to, RPM history, microphone spectra or time dependent signals, microphone-based acoustic performance data, Voice Activity Detector (VAD) data and history, and predetermined error microphone nonstationary event detection thresholds in the time or frequency domain. In addition, the processor 128 may analyze the RPM sensor and microphone data and extract key features to determine a set of parameters to be applied to the EOC system 100. The set of parameters may be selected when triggered by an event. In one or more embodiments, the processor 128 and storage 130 may be integrated with one or more EOC system controllers, such as the adaptive filter controller 120.

The simplified EOC system schematic depicted in FIG. 1 shows one secondary path, represented by S(z), between each speaker 124 and each microphone 112. As previously mentioned, EOC systems typically have multiple speakers, microphones and noise signal generators. Accordingly, a 6-speaker, 6-microphone EOC system will have 36 total secondary paths (i.e., 6×6). Correspondingly, the 6-speaker, 6-microphone EOC system may likewise have 36 S'(z) filters (i.e., secondary path filters 122), which estimate the transfer function for each secondary path. As shown in FIG. 1, an EOC system will also have one W(z) filter (i.e., controllable filter 118) between each noise signal X(n) from a noise signal generator 108 and each speaker 124. Accordingly, a 5-noise signal generator, 6-speaker EOC system may have 30 W(z) filters. Alternately, a 6-frequency generator 248, 6-speaker EOC system may have 36 W(z) filters.

Figure 3A:
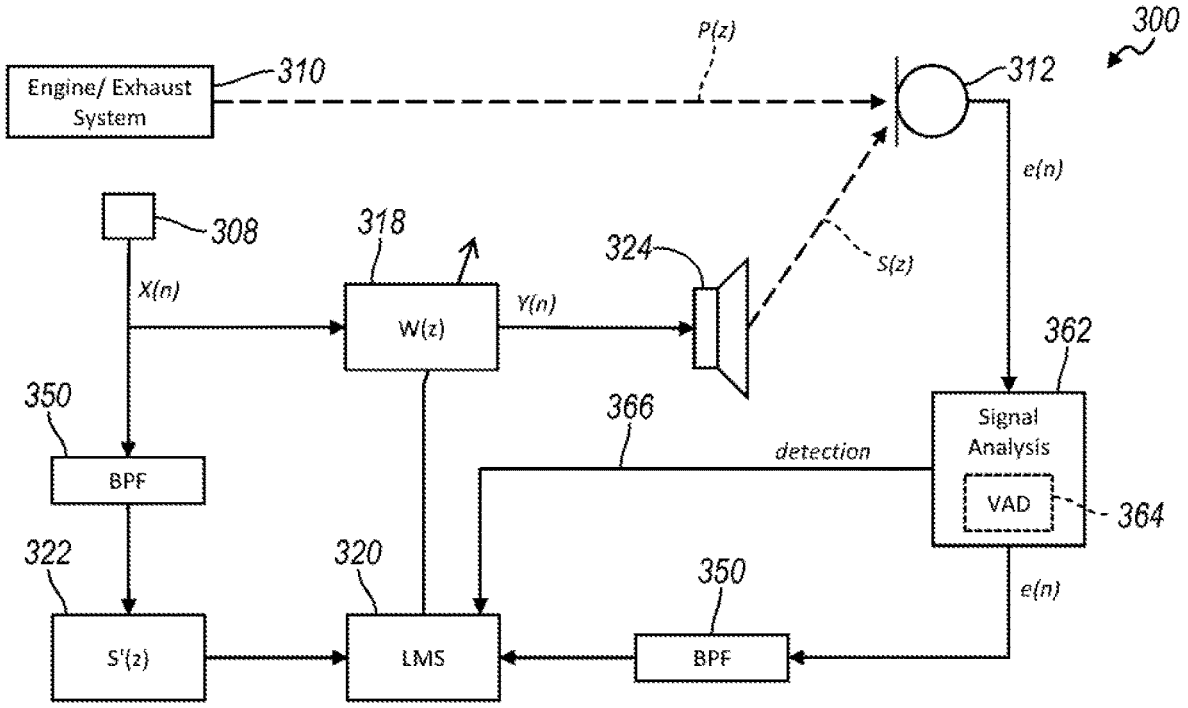
FIG. 3*a* is a schematic block diagram representing an EOC system including a signal analysis controller, in accordance with one or more embodiments of the present disclosure.
Figure 3B:
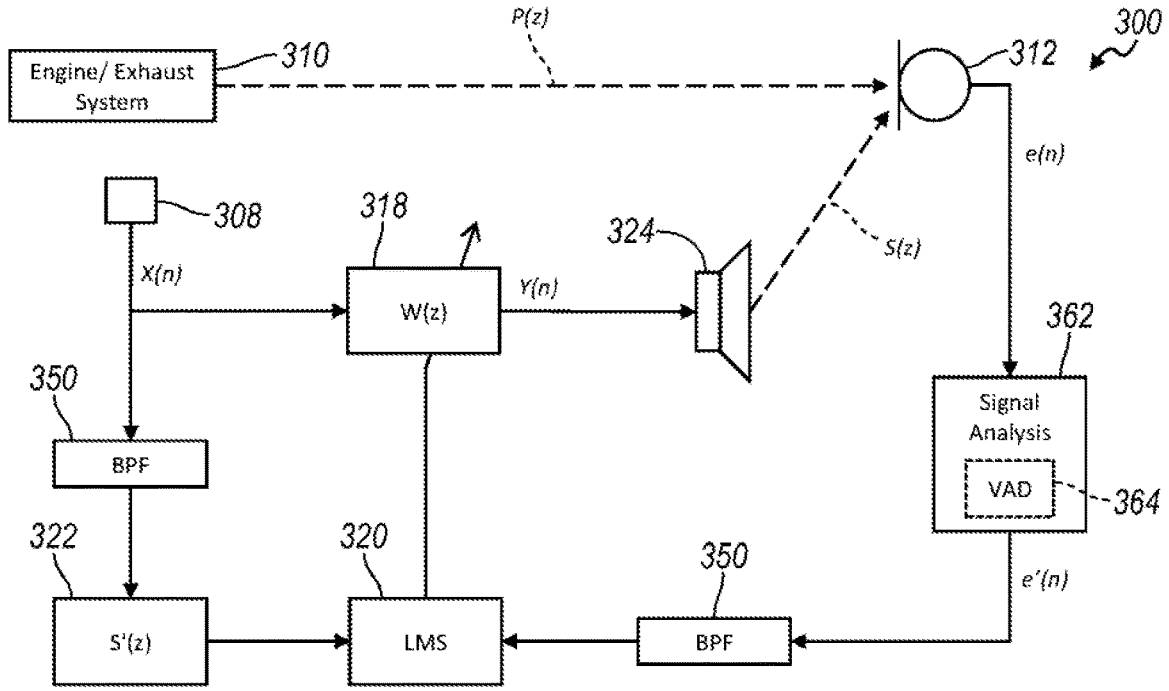
FIG. 3*b* is a schematic block diagram representing an alternative EOC system including a signal analysis controller.

FIGS. 3*a-b* are schematic block diagrams representing an EOC system 300, in accordance with one or more embodiments of the present disclosure. The EOC system 300 may be a Filtered-X Least Mean Squares (FX-LMS) EOC system, as understood by those of ordinary skill in the art. Similar to EOC system 100, the EOC system 300 may include elements 308, 310, 312, 318, 320, 322, and 324, consistent with operation of elements 108, 110, 112, 118, 120, 122, and 124, respectively, discussed above. FIGS. 3*a-b* also shows the primary path P(z) and secondary path S(z), as described with respect to FIG. 1. Because engine order noise is narrow band, the error microphone signal e(n) may be filtered by a bandpass filter 350 prior to passing into the LMS-based adaptive filter controller 320. In an embodiment, the noise signal X(n) output by the noise signal generator 308 is bandpass filtered using the same bandpass filter parameters. Because the frequency of the various engine orders differs, each engine order may have its own bandpass filters having different high- and low-pass filter corner frequencies. The number of frequency generators and corresponding noise-cancellation components will ultimately vary based on the number of engine orders desired to be reduced in level for a particular vehicle.

As set forth above, EOC systems are susceptible to mis-adaptation due to non-stationary events, such as when driving over train tracks, hitting a pothole, driving over a speedbump, a passenger tapping on an error microphone, or even when a voice is present in the vehicle. If the LMS system adapts the W-filters based on non-stationary signals, the EOC performance may be degraded in the time period immediately afterward because these non-stationary signals are transient in nature and have a different spatial and phase character than the sound during the steady-state driving, in absence of these interfering signals. Adaptation of the LMS system with non-stationary inputs is described as mis-adaptation, due to the degraded noise cancellation performance that can result following the non-stationary input. For instance, the fundamental frequencies of a male voice typically fall within the frequency range of EOC systems, thereby creating undesirable audible artifacts in the passenger cabin if the EOC system is adapted during this speech.

When speech is present in the passenger cabin, the voice energy adds to the engine order noise sensed by the error microphones. A conventional adaptive LMS EOC system will begin to adapt to the combination of voice and noise in attempt to cancel the combination. Anti-noise is produced by the EOC system to cancel the combined voice and engine sounds and, due to the system delay, reaches a vehicle occupant's ears approximately 7 milliseconds later. That delay, coupled with the non-stationary nature of speech, means that the anti-noise will not only fail to cancel the voice, but will instead lead to a speech-like "post-echo" in the cabin. With stationary noise sources such as engine noise, this 7 ms delay is not problematic because engine noise, predominantly a series of sine wave harmonics, repeats nearly identically, cycle after cycle during constant speed driving. However, this is not the case with non-stationary signals, such as voice. By the time the anti-noise reaches the passenger cabin, it does not effectively cancel the voice, as the source of the voice is now uttering a different sound.

In addition to a speech-like "post-echo" in the cabin, another potential drawback to EOC error microphones picking up non-stationary noises like speech is the effect on adaptation of the particular engine order. After the voice ends (because a passenger stops speaking at certain frequencies or stops speaking altogether), the phase and magnitude of each engine order anti-noise filter for orders in the range of the 85-170 Hz octave are no longer optimal for the cancellation of the engine noise because they've partially converged to cancel the combination of voice and engine noise. Accordingly, for a brief period of time, the EOC may also not be optimal. It will remain suboptimal until the EOC system reconverges. The net effect of this suboptimal cancellation is an apparent fluctuation of the level of that engine order.

Mis-adaptation of the W-filters in response to non-stationary, transient events may be prevented by detecting such events and mitigating their effect on the LMS adaptation algorithm. To detect a non-stationary event, such as the presence of speech in the passenger cabin, or events such as driving over train tracks, hitting a pothole, or tapping on error microphones, the error signal(s) e(n) output from one or multiple microphones in the EOC system may be evaluated. The error signal e(n) of each microphone channel may be an analog or digital signal. Evaluation of the time history or frequency domain content of these output signals may identify non-stationary, transient events when they occur. For instance, driving over a pothole may cause a relatively high amplitude, short duration pulse to appear on a microphone output. It is likely that this high amplitude (i.e., possibly full-scale), short-duration signal will appear on more than one of the microphones, perhaps during different frames.

To detect such non-stationary events, the EOC system 300 may further include at least one signal analysis controller 362. The signal analysis controller 362 may include a processor and memory (not shown), such as processor 128 and storage 130, programmed to evaluate and detect non-stationary events, including speech and other impulsive events, that are contained within the time-dependent error signal e(n). This may include computing parameters by analyzing time samples from a frame of error signal e(n) in either or both the time domain or frequency domain. The signal analysis controller 362 may be disposed along the path between the error microphone 312 and the adaptive filter controller 320. Alternately, the signal analysis controller 362 may be disposed along the path between the band pass filter 350 and the adaptive filter controller 320. The signal analysis controller 362 may be a dedicated controller for detecting non-stationary signals or may be integrated with another controller or processor in the EOC system 300, such as the LMS adaptive filter controller 320. Alternatively, the signal analysis controller 362 may be integrated into another controller or processor within vehicle 102 that is separate from the other components in the EOC system.

According to one or more embodiments, the signal analysis controller 362 may include a voice activity detector (VAD) 364 for analyzing the error signal e(n) to detect the presence of speech or other nonstationary signals. Alternatively, the VAD 364 may be a separate component from, but in communication with, the signal analysis controller 362 for evaluating the error signal e(n). Nonstationary events such as speech can be detected by VADs. Though many variants are known to those of ordinary skill in the art, VADs generally work by analyzing audio data on a frame by frame basis. Typical approaches may include applying a peak tracker, to determine the amplitude and number of peaks in a frame, and a valley tracker (or some other type of average RMS level detector). The parameters and thresholds employed by a VAD to determine if speech has been detected are completely configurable. In general, though, when a certain number of peaks exceed a predetermined value (e.g., the average RMS level plus a predetermined amount) over a predetermined duration, speech may be detected. Naturally, setting these thresholds is a tradeoff between false detection and false rejections (i.e., a non-speech event mistaken for speech or real speech not detected as such). The minimum detection time, then, is one single frame, which can be on the order of a milliseconds.

Detection of speech in silence is trivial, and so it is the presence of background noise that makes the accurate detection of speech by a VAD more difficult. The first VADs implemented based their binary decisions on simple features, such as short-term energy and zero-crossing rate. These techniques can work well in high Signal to Noise Ratio (SNR) scenarios. More sophisticated signal processing techniques can be added to VADs, including spectral shape, harmonicity, and periodicity analysis. The normalized autocorrelation coefficient, which is a measure of temporal correlation can be used in VADs to help improve detection accuracy in extremely low SNR, random sound environments. The calculation of features such as spectro-temporal modulation or amplitude modulation spectrogram can be optionally implemented into a VAD. More recently, several sophisticated statistical model-based VAD approaches were developed to further increase accuracy in adverse SNR environments.

Initially, only data from the current analysis frame was used in the decision-making process. However, over time it was found that long term history of both the speech and the background noise characteristics could be used to increase accuracy of the VAD decision. In effort to go beyond dynamic thresholding based on averaging, more advanced classifiers, such as Gaussian mixture models or neural networks, can be trained to distinguish speech from noise based on the aforementioned features and statistics. Though the VAD output is binary, more sophisticated approaches are possible, including applying static or dynamic thresholds to speech presence probability. The goal of all of these various techniques is to select thresholds that balance false detection, such as noise detected as speech and hangover after the speech has ended, and false rejection, such front end of speech clipping and middle of speech clipping. In various embodiments, any or all of these or other additional techniques can be combined into the VAD 364.

In response to detecting speech or another non-stationary event, the EOC system 300 may slow adaptation of some or all of the controllable filters 318, or pause adaptation altogether, for the duration of the frame in which the event is detected. The LMS algorithm's step size controls the rate of adaptation. A smaller step-size slows the adaptation of the controllable filters 318 based on the RPM and microphone inputs. Reducing the step size for the duration of a frame results in the controllable filters 318 changing less than they otherwise would due to the presence of these nonstationary inputs. Reducing the step-size to zero effectively pauses the adaption, by preventing adaptation of the controllable filters 318 based on these nonstationary signals for the duration of the frame. Pausing or slowing the rate of adaptation may prevent the EOC system 300 from mis-adapting, which may in turn prevent a speech-like post-echo and/or an apparent fluctuation of engine order noise in the cabin.

In real world and text book in-vehicle noise cancellation systems, the LMS system adaptation rate is regulated not only by a step size, but by a normalized step size. In such a system, the step size is divided by a quantity relative to the energy in the DSP frame of a sensor such as an error microphone. This approach can have several advantages, such as causing the system to adapt at the same rate in quiet or loud operating scenarios. Therefore, in certain embodiments, a loud voice may cause an analog reduction in step size during the duration of the voice. However, the EOC system described in the present disclosure allows for a digital reduction in step size, once a threshold has been exceeded, but no reduction otherwise. In an embodiment, these techniques can be used together for an even better performing noise cancellation system.

Other, equivalent methods to pause adaptation for the duration of the frame may be employed, such as a repetition of the previous frame's controllable filter(s) 318 rather than updating the controllable filter(s) based on an input frame containing a non-stationary event. In one or more embodiments, the signal analysis controller 362 may inform the LMS adaptive filter controller 320 when a non-stationary event such as speech is detected using detection signal 366, as illustrated in FIG. 3*a*. In response to the detection signal 366, the adaptive filter controller 320 may modify an adaptation parameter to prevent or minimize mis-adaptation, such as by reducing the step size of its adaptation algorithm for the duration of the frame or of the nonstationary event.

As an alternative to modifying an adaptation parameter using the detection signal 366, the signal analysis controller 362 may generate an adjusted error signal e'(n) in response to detecting a non-stationary event, as depicted in FIG. 3*b*. The adjusted error signal e'(n) may be the error microphone signal e(n) with the detected speech or other non-stationary input removed. By adaptively subtracting voice signals out of the error microphone signals, the EOC system won't attempt to cancel the frequencies of speech or other non-stationary noise that coincide in frequency with the engine orders the EOC system is attempting to cancel. Thus, the adjusted error signal e'(n) may prevent the controllable filter 318 from mis-adapting due to a non-stationary or transient event and also the speech-like post-echo may be prevented. If a non-stationary event like speech is not detected, the signal analysis controller 362 may not adjust the error signal e'(n) such that the error signal e(n) may be passed through to the controllable filter 318 and/or the adaptive filter controller 320.

In order to remove or reduce speech or the like from the error signals e(n), single microphone or multi-microphone noise suppression algorithms, such as those used in telephony, may be employed to create a signal that contains primarily voice. The speech component of the error microphone signal e(n) may then be removed by subtracting the voice signal representing the non-stationary speech from the error microphone signal e(n) to obtain the adjusted error signal e'(n). Although these one- and multi-microphone noise suppression algorithms may have some latency, it is not critical to the performance of the EOC algorithm, especially when the vehicle is operated at a steady state RPM, because this latency will only affect the update of the W-filters and will not delay the creation of the anti-noise itself. Complete removal of the speech from the error signal e(n) may not be possible and is not necessary to improve the performance of the EOC algorithm and prevent mis-adaptation.

Figure 4:
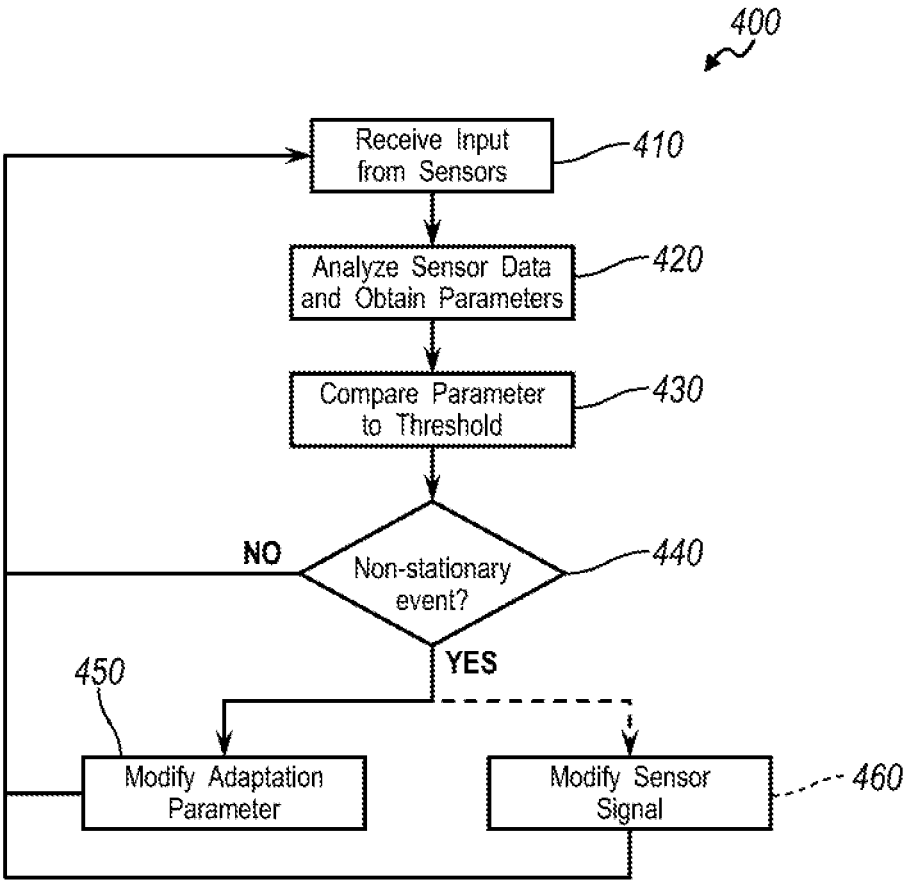
FIG. 4 is a flowchart depicting a method for preventing mis-adaptation of controllable filters in an EOC system due to non-stationary events such as speech in a passenger cabin, in accordance with one or more embodiments of the present disclosure.

FIG. 4 is a flowchart depicting a method 400 for preventing mis-adaptation of controllable filters in an EOC system due to non-stationary events such as speech occurring in the passenger cabin of a vehicle. Various steps of the disclosed method may be carried out by the signal analysis controller 362, either alone, or in conjunction with other components of the EOC system 300. Moreover, certain descriptions of the method may be explained in connection with detecting speech or another non-stationary event such as incident wind, or a passenger rubbing or striking a microphone 312, based on the error signal e(n) from a microphone 312.

At step 410, the EOC system 300 may receive sensor signals such as error signals e(n) from at least one microphone 312. The EOC system 300 may also receive sensor signals from other acoustic sensors in the passenger cabin, such as an acoustic energy sensor, an acoustic intensity sensor, or an acoustic particle velocity or acceleration sensor. To this end, a group of samples of time data from a microphone 312 may be received by the signal analysis controller 362. The group of samples of time data may form one digital signal processing (DSP) frame. In an embodiment, 64 time samples of the output from a sensor (i.e., microphone 312) may form a single DSP frame. In alternate embodiments, greater or fewer time samples may compose a single frame.

At step 420, an analysis of the sensor data within a frame may be performed. In various embodiments, this analysis may include calculating, extracting or otherwise obtaining one or more parameters from each frame of sensor data sampled from, for example, the error signal e(n). In an example, the signal analysis controller 362 may calculate the fast Fourier transform (FFT) of the frame to form a frequency domain representation of the input from the error microphone e(n). The analysis may further include evaluating the FFT in one or multiple frequency ranges, or in individual frequency bins. For instance, non-stationary, transient events are typically a short duration impulse, which in the frequency domain is a very broadband signal. Thus, the character of many non-stationary event signals in the frequency domain is quite different than the character of the vehicle signal in steady-state. Obtaining and analyzing a parameter from the frame such as a level of one or more frequency ranges may therefore enable detection of a non-stationary event. In other examples, the analysis could also include computing parameters such as the total energy within the DSP frame or the peak or highest amplitude of all the time samples within the frame. Because the amplitude of the error microphone signal created by a non-stationary event can be much higher amplitude than the error microphone signal created by driving in steady state, analyzing these parameters may also enable detection.

Step 420 may also include storing the parameter(s) or error microphone data of a current frame for use in analyzing future frames of microphone data. This may be helpful in evaluating and detecting nonstationary events that may include speech. In an embodiment, the parameter(s) or microphone data from the frame immediately prior to a current frame may be stored. In another embodiment, a statistical analysis may be performed on the parameters obtained from multiple prior frames of microphone data to determine a threshold. For instance, a short- or long-term average of a parameter obtained from multiple preceding frames may be calculated and stored as its own parameter for use in step 430, either as a threshold or to obtain a difference from the current frame for comparison to a threshold. In certain of these embodiments, a predetermined gain margin may be added to the average value (or other statistical value) calculated from multiple preceding frames to form a threshold. This may include adding a gain margin of 20%, 50% or 100% to the average value, or other statistical value. Thus, the average value from multiple preceding frames may be multiplied by a gain factor (e.g., 120%, 150%, 200%, etc,) to obtain the threshold. In other embodiments, other gain factors are possible. In another embodiment, a threshold may be calculated using data from other sensors in the EOC system using any combination of the aforementioned threshold-deriving techniques. Additionally, a threshold may be derived by analyzing the current frame or a past frame or frames of microphone data from any, or combinations of any, error microphone signals from other error microphones.

At step 430, the parameter computed from the current frame of error microphone data may be compared directly to a corresponding threshold. If the parameter from the current frame exceeds the threshold, the signal analysis controller 362 may conclude a non-stationary event has been detected. If the parameter from the current frame does not exceed the threshold, the signal analysis controller 362 may conclude that no nonstationary event has been detected. For instance, the signal analysis controller 362 may compute the energy in the current frame or a peak amplitude of the current frame and compare the energy value or peak amplitude to a corresponding threshold to determine whether a nonstationary event such as speech has occurred.

Alternatively, the parameter computed from the current frame of microphone data may be may be compared to a statistical value (e.g., average value) of the same parameter from one or more previous frames of microphone data obtained from either the same error microphone signal, one or more error microphone signals from other error microphones, or any combination thereof, as previously described. The difference between the current frame's parameter and the statistical value may then be compared to a threshold. If the difference exceeds the threshold, the signal analysis controller 362 may conclude a non-stationary event has been detected. If the difference does not exceed the threshold, the signal analysis controller 362 may conclude that a non-stationary event has not been detected. For example, in an embodiment, the signal analysis controller 362 may compute the energy in the current frame and compare it to the energy in a previous frame, noting that any difference exceeding a predetermined threshold may be indicative of a non-stationary signal, such as hitting a pothole. In another embodiment, the FFT of a current frame of the noise signal output from a noise signal generator may be calculated and compared to the FFT of the previous frame, noting that a change on the level of one or more FFT bins beyond a predetermined threshold may also be indicative of a non-stationary signal.

In one or more embodiments, the threshold may be a predetermined static threshold set and programmed by trained engineers during the tuning of the EOC system and its corresponding algorithms. In alternate embodiments, the threshold may be a dynamic threshold computed from a statistical analysis of the parameter obtained in one or more preceding frames as discussed above with regard to step 420. For instance, the threshold may be a short- or long-term average value of a parameter taken from multiple preceding frames. Moreover, the average value may be enhanced by a gain factor, as previously discussed, to establish the dynamic threshold. In yet another embodiment, the threshold may simply be the value of the parameter from the previous frame of time data, which may also be multiplied by a gain factor.

The signal analysis controller 362 may also apply temporal thresholding in conjunction with the aforementioned variants of amplitude thresholding at step 430. For example, some impulsive, non-stationary events induce a high amplitude output signal with a duration of 1 to 100 ms. Thus, temporal thresholding may further aid in the detection of nonstationary events. For instance, when the amplitude of samples in the current frame exceeds an amplitude threshold for less than a predetermined temporal threshold, an impulsive, non-stationary event may be detected.

As previously described, the signal analysis controller 362 may employ voice activity detector (VAD) 364 for analyzing speech or other nonstationary signal components of the error signal e(n). Nonstationary events such as speech can be detected by VADs by analyzing audio data on a frame by frame basis in step 420. Typical approaches may include applying a peak tracker, to determine the amplitude and number of peaks in a frame, and a valley tracker (or some other type of average RMS level detector). When a certain number of peaks exceed the average RMS level by a certain amount over a certain duration, speech may be detected. The parameters and thresholds employed by the VAD 364 to determine if speech has been detected is completely configurable.

Referring to step 440, when a non-stationary event is detected, the method may proceed to step 450 in which an adaptation parameter in the LMS algorithm is modified to prevent the EOC system from mis-adapting or diverging due to the non-stationary event. In an embodiment, the method may proceed to step 460 in which the sensor signal (e.g., error signal e(n)) itself is modified in attempt to mask, reduce or eliminate the non-stationary event and prevent mis-adaptation. However, when a non-stationary event is not detected, the method may skip any adaptation parameter or signal modification and return to step 410 so the process can repeat with a new frame of sensor data. In an embodiment, both steps 450 and 460 can be executed in effort to prevent mis-adaptation.

At step 450, upon detection of speech or another non-stationary event, an adaptation parameter may be modified. In particular, the LMS algorithm's step size may be reduced. The LMS algorithm's step-size controls the rate of adaptation. A smaller step-size slows the adaptation of the controllable filters 318 based on the microphone sensor inputs. In one or more embodiments, the signal analysis controller 362 may inform the LMS controller 320 when a non-stationary event is detected using detection signal 366 so that the LMS controller may reduce the step size of its adaptation algorithm for the duration of the frame or of the nonstationary event. Reducing the step size for the duration of this frame may result in one or more of the controllable filters 318 changing less than they otherwise would have due to the presence of these speech or other non-stationary inputs. In certain embodiments, adaptation of one or more controllable filters may be paused altogether by reducing the step size to zero for the duration of the frame, or by other techniques known to those of ordinary skill in the art. In an embodiment, the step size can be reduced for a duration greater than the one frame in which the non-stationary event, such as speech, was detected. In certain embodiments, modifying an adaption parameter may include deactivating the EOC system for the duration of the frame.

In an alternative embodiment at step 460, sensor signal itself may be modified to mask the non-stationary event and prevent mis-adaption based on transient, non-stationary events. As described above with respect to FIG. 3*b*, the error signal e(n) may be modified to create an adjusted error signal e'(n). The adjusted error signal e'(n) may be the error microphone signal e(n) with the detected speech or other non-stationary input removed in a manner described in detail above using, for example noise suppression algorithms. Moreover, if a frame containing a non-voice non-stationary event is detected and modified, to remove the nonstationary noise in an analogous manner to how voice is removed from the error signal e(n), then mis-adaptation due to this event may also be minimized or prevented. In an embodiment, the data in the current frame can be replaced by zeroes or by samples that contain the averaged values of one or more previous frames. In an embodiment, an alternate error signal e(n) from a different system microphone may be substituted for the error signal e(n) that contained the nonstationary event, thereby forming the adjusted error signal e'(n).

In certain embodiments, more sophisticated solutions are possible, wherein only during the duration of the nonstationary event is the error signal e(n) modified. This may further mask any effect of the nonstationary event. Other techniques are possible, such as repeating the last frame of the output error signal, rather than modifying it. The adjusted error signal e'(n) may then be supplied to the band pass filter 350 or adaptive filter controller 320 for use in adapting the controllable filter 318 with minimal impact from passenger speech or other nonstationary noise events.

If the non-stationary event is not completely eliminated in the adjusted error signal e'(n), an additional measure can be undertaken to expedite re-adaptation to improve EOC performance after the voice or non-stationary event ends. In an embodiment, the step size can be increased for the one or more adjustable W-filters. The duration of this step size increase can be for one or more frames, or until the system has re-adapted to restore the pre-nonstationary event noise cancelling performance. In an embodiment, leakage can be increased for a duration of one or more frames in an effort more quickly to reduce the effect of the mis-adaptation on the W-filters.

Although FIGS. 1 and 3*a-b* show LMS-based adaptive filter controllers 120 and 320, respectively, other methods and devices to adapt or create optimal controllable W-filters 118 and 318 are possible. For example, in one or more embodiments, neural networks may be employed to create and optimize W-filters in place of the LMS adaptive filter controllers. In other embodiments, machine learning or artificial intelligence may be used to create optimal W-filters in place of the LMS adaptive filter controllers.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. Equations may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Those of ordinary skill in the art understand that functionally equivalent processing steps can be undertaken in either the time or frequency domain. Accordingly, though not explicitly stated for each signal processing block in the figures, the signal processing may occur in either the time domain, the frequency domain, or a combination thereof. Moreover, though various processing steps are explained in the typical terms of digital signal processing, equivalent steps may be performed using analog signal processing without departing from the scope of the present disclosure.

Benefits, advantages and solutions to problems have been described above with regard to particular embodiments. However, any benefit, advantage, solution to problems or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

What is claimed is:

1. A method for preventing mis-adaptation in a feed-forward engine order cancellation (EOC) system, the method comprising:

adjusting an adaptive transfer characteristic based on a noise signal received from a noise signal generator, an error signal received from a microphone located in a cabin of a vehicle, and an adaptation parameter;

generating an anti-noise signal based in part on the adaptive transfer characteristic, the anti-noise signal to be radiated by a speaker as anti-noise within the cabin of the vehicle;

detecting a non-stationary event based on signal parameters sampled from a frame of the error signal; and modifying the adaptation parameter for a duration of the frame in response to detecting the non-stationary event.

2. The method of claim 1, wherein detecting a non-stationary event based on signal parameters sampled from a frame of the error signal comprises:

comparing at least one signal parameter of a current frame for the error signal to a threshold; and detecting the non-stationary event when the at least one signal parameter exceeds the threshold.

3. The method of claim 2, wherein the signal parameter is one of a peak amplitude of the error signal sampled in the frame and an energy value of each frame.

4. The method of claim 2, wherein the threshold is a predetermined static threshold programmed for the EOC system.

5. The method of claim 2, wherein the threshold is a dynamic threshold computed from a statistical analysis of the at least one signal parameter in one or more preceding frames of the error signal.

6. The method of claim 1, wherein detecting a non-stationary event based on signal parameters sampled from a frame of the error signal comprises:

applying a peak tracker and a valley tracker, using a voice activity detector, to a current frame of the error signal to determine the amplitude and number of peaks in the current frame; and detecting a presence of speech when a predetermined number of peaks exceed a predetermined value over a predetermined duration.

7. The method of claim 1, wherein modifying an adaption parameter includes reducing a rate of adaptation of one or more controllable filters.

8. The method of claim 1, wherein modifying an adaption parameter includes pausing adaptation of one or more controllable filters by reducing a rate of adaptation of the controllable filters to zero.

9. The method of claim 1, wherein modifying an adaption parameter includes deactivating the EOC system for the duration of the frame.

10. An engine order cancellation (EOC) system comprising:

a noise signal generator, having a frequency generator, adapted to generate a noise signal in response to an input;

a controllable filter adapted to generate an anti-noise signal based in part on an adaptive transfer characteristic, the anti-noise signal to be radiated by a speaker as anti-noise within a cabin of a vehicle;

an adaptive filter controller, including a processor and memory, programmed to control the adaptive transfer characteristic of the controllable filter based on the noise signal received from the noise signal generator, an error signal received from a microphone located in the cabin of the vehicle, and an adaptation parameter; and a signal analysis controller, including a processor and memory, programmed to:

detect a non-stationary event based on parameters sampled from a current frame of the error signal; and modify at least one of the adaptation parameter and the error signal in response to detecting the non-stationary event.

11. The EOC system of claim 10, wherein the adaptation parameter determines a rate of change of the adaptive transfer characteristic for the controllable filter.

12. The EOC system of claim 11, wherein the signal analysis controller is programmed to modify the adaption parameter by reducing a rate of adaptation of the controllable filters.

13. The EOC system of claim 10, wherein the signal analysis controller is programmed to modify the error signal by removing non-stationary noise indicated by the non-stationary event to generate an adjusted error signal.

14. The EOC system of claim 10, further comprising a voice activity detector in communication with the signal analysis controller that detects speech present in the error signal, wherein the non-stationary event includes the speech.

15. The EOC system of claim 14, wherein the voice activity detector is configured to determine a zero-crossing rate in the current frame of the error signal.

16. The EOC system of claim 10, wherein the signal analysis controller is programmed to detect a non-stationary event based on parameters sampled from a current frame of the error signal by comparing at least one signal parameter of a current frame for each error signal to a threshold.

17. The EOC system of claim 10, wherein the noise signal generator further includes an RPM sensor and a lookup table.

18. A non-transitory computer readable medium storing instructions for engine order cancellation (EOC), the instructions comprising:

one or more instructions that, when executed by one or more processors, cause the one or more processors to:

receive noise signals from at least one noise signal generator;

generate an anti-noise signal to be radiated by a speaker as anti-noise within a cabin of a vehicle, the anti-noise signal being generated by at least one controllable filter based in part on the noise signals from the at least one noise signal generator;

receive error signals from at least one microphone located in the cabin of the vehicle;

detect a non-stationary event based on signal parameters sampled from a frame of at least one error signal; and modify the anti-noise signal for the duration of the frame in response to detecting the non-stationary event.

19. The non-transitory computer readable medium of claim 18, wherein the one or more instructions, that cause the one or more processors to modify the anti-noise signal for the duration of the frame in response to detecting the non-stationary event, cause the one or more processors to:

modify an adaptation parameter that controls a rate of adaptation of the controllable filter.

20. The non-transitory computer readable medium of claim 18, wherein the one or more instructions, that cause the one or more processors to modify the anti-noise signal for the duration of the frame in response to detecting the non-stationary event, cause the one or more processors to:

modify the error signal by removing non-stationary noise indicative of the non-stationary event to obtain an adjusted error signal.

* * * * *